US009874227B2

(12) United States Patent
Tadokoro et al.

(10) Patent No.: US 9,874,227 B2
(45) Date of Patent: Jan. 23, 2018

(54) AIR BLOWER AND OUTDOOR UNIT

(71) Applicant: Mitsubishi Electric Corporation, Tokyo (JP)

(72) Inventors: Takahide Tadokoro, Tokyo (JP); Yasuaki Kato, Tokyo (JP); Atsushi Kono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 238 days.

(21) Appl. No.: 14/899,384

(22) PCT Filed: Jul. 5, 2013

(86) PCT No.: PCT/JP2013/068512

§ 371 (c)(1),
(2) Date: Dec. 17, 2015

(87) PCT Pub. No.: WO2015/001663

PCT Pub. Date: Jan. 8, 2015

(65) Prior Publication Data

US 2016/0146217 A1 May 26, 2016

(51) Int. Cl.
*F04D 29/52* (2006.01)
*F04D 19/00* (2006.01)
(Continued)

(52) U.S. Cl.
CPC ..... *F04D 29/522* (2013.01); *F04D 19/002* (2013.01); *F04D 25/08* (2013.01);
(Continued)

(58) Field of Classification Search
CPC ..... F04D 19/002; F04D 25/08; F04D 29/325; F04D 29/522; F04D 29/547; F04D 29/703; F05D 2250/73
See application file for complete search history.

(56) References Cited

U.S. PATENT DOCUMENTS 2,538,739 A * 1/1951 Troller ..... F04D 19/002 415/210.1
2,544,490 A * 3/1951 Curley ..... F04D 29/545 415/201
(Continued)

FOREIGN PATENT DOCUMENTS

JP 57-075199 U 10/1980
JP 57-137970 U 8/1982
(Continued)

OTHER PUBLICATIONS

International Search Report of the International Searching Authority dated Sep. 10, 2013 for the corresponding International application No. PCT/JP2013/068512 (and English translation).

*Primary Examiner* — Igor Kershteyn
(74) *Attorney, Agent, or Firm* — Posz Law Group, PLC

(57) ABSTRACT

An air blower includes a casing having an air inlet portion and an air outlet portion, a fan, and a fan guard. The fan includes a boss portion and a plurality of blades. The fan guard includes a guide portion having a tubular outer shape, which protrudes toward the fan. A center in a distal end shape, which is defined by a contour line of a distal end portion of the guide portion, matches with a rotation axis of the boss portion. A center in a root shape, which is defined by a contour line of a root portion of the guide portion, is shifted with respect to the rotation axis of the boss portion.

10 Claims, 11 Drawing Sheets

(51) Int. Cl.

| | |
|---|---|
| ***F04D 29/32*** | (2006.01) |
| ***F04D 25/08*** | (2006.01) |
| ***F04D 29/70*** | (2006.01) |
| ***F04D 29/54*** | (2006.01) |

(52) U.S. Cl.
CPC ..... *F04D 29/325* (2013.01); *F04D 29/547* (2013.01); *F04D 29/703* (2013.01); *F05D 2250/73* (2013.01)

(56) References Cited

U.S. PATENT DOCUMENTS

| | | | | |
|---|---|---|---|---|
| 3,324,784 | A * | 6/1967 | Lambie | F04D 29/526 415/207 |
| 4,318,693 | A * | 3/1982 | Gutzwiller | F27B 5/16 415/206 |
| 5,951,247 | A * | 9/1999 | Rockwell | F04D 29/541 415/208.3 |
| 8,282,348 | B2 * | 10/2012 | Carl, Jr. | F04D 25/068 415/209.4 |
| 2010/0269537 | A1 * | 10/2010 | Tadokoro | F04D 29/526 62/426 |
| 2011/0192186 | A1 * | 8/2011 | Kato | F04D 29/162 62/324.3 |

FOREIGN PATENT DOCUMENTS

| | | | |
|---|---|---|---|
| JP | 58-131382 | U | 9/1983 |
| JP | 2001-140797 | A | 5/2001 |
| JP | 2001-140798 | A | 5/2001 |
| JP | 2003-307199 | A | 10/2003 |

* cited by examiner

AIR BLOWER AND OUTDOOR UNIT

CROSS REFERENCE TO RELATED APPLICATION

This application is a U.S. national stage application of PCT/JP2013/068512 filed on Jul. 5, 2013, the contents of which are incorporated herein by reference.

TECHNICAL FIELD

The present invention relates to an air blower and an outdoor unit.

BACKGROUND ART

An axial-flow fan includes a boss portion located at a rotation center portion, and a plurality of blades formed so as to extend from an outer circumferential surface of the boss portion toward a radially outer side. On a downstream side of the boss portion in the axial-flow fan, a flow passing along each of the blades to be blown out and a flow stagnating in a region on an immediately downstream side of the boss portion are mixed, thereby becoming a turbulent flow having a backflow and a vortex. Such a turbulent flow may cause energy loss and increase in noise.

In this case, as the related-art air blower including an axial-flow fan, in Patent Literature 1, there is disclosed a structure in which a conical guide having a diameter expanding toward the downstream side is provided on the downstream side of the axial-flow fan, to thereby suppress separation of the flow to be blown out.

Further, in Patent Literature 2, there is disclosed a configuration in which a guide having an expanding diameter is mounted on a downstream side of an impeller and the guide has a groove formed in an inclined surface thereof.

CITATION LIST

Patent Literature

[PTL 1] JP 57-75199 U
[PTL 2] JP 2001-140797 A

SUMMARY OF INVENTION

Technical Problem

As described above, on the downstream side of the boss portion in the axial-flow fan, the turbulent flow is generated, which may cause energy loss and increase in noise. It is desired to deal with such a flow, to thereby suppress the energy loss and increase in noise. However, as a result of the investigation conducted by the inventors of the present invention, such a turbulent flow exhibits a complicated state depending on difference in states at circumferential positions during one rotation of the fan. Further, the guide disclosed in each of Patent Literature 1 and Patent Literature 2 is provided simply for the purpose of rectification and prevention of the separation, and is not configured to be able to address the difference in states at the circumferential positions during one rotation of the fan.

The present invention has been made in view of the above, and has an object to provide an air blower and an outdoor unit, which are capable of reducing turbulence of a flow on a downstream side of a boss portion over an entire circumferential rotation direction of a fan.

Solution to Problem

In order to achieve the above-mentioned object, according to one embodiment of the present invention, there is provided an air blower, including: a casing having an air inlet portion and an air outlet portion; a fan provided in the casing so as to be rotatable; and a fan guard provided at the air outlet portion of the casing, in which: the fan includes a boss portion, and a plurality of blades provided on an outer circumferential surface of the boss portion; the fan guard includes a guide portion having a tubular outer shape, which protrudes toward the fan; a center in a distal end shape, which is defined by a contour line of a distal end portion of the guide portion, matches with a rotation axis of the boss portion; and a center in a root shape, which is defined by a contour line of a root portion of the guide portion, is shifted with respect to the rotation axis of the boss portion.

It is preferred that: on an inlet side of the fan, airflow resistance be larger on one radial side than on another radial side across the rotation axis of the boss portion; and a distance between the contour line of the root portion of the guide portion and the rotation axis of the boss portion on the one side on which the airflow resistance is relatively large be larger than a distance between the contour line of the root portion of the guide portion and the rotation axis of the boss portion on the another side on which the airflow resistance is relatively small.

It is preferred that: the fan guard include a plurality of rib portions arrayed in a lattice shape; and intervals between the plurality of rib portions on the one side on which the airflow resistance is relatively large be set to be larger than intervals between the plurality of rib portions on the another side on which the airflow resistance is relatively small, or the plurality of rib portions on the one side on which the airflow resistance is relatively large be configured to be significantly inclined with respect to the rotation axis of the boss portion more than the plurality of rib portions on the another side on which the airflow resistance is relatively small.

It is preferred that the guide portion include a tubular body extending along the rotation axis of the boss portion from the root portion to the distal end portion and allowing an air stream to pass through the tubular body.

In order to achieve the above-mentioned object, according to one embodiment of the present invention, there is also provided an outdoor unit, including the above-mentioned air blower, in which a heat exchanger is further arranged in the casing.

It is preferred that: in the casing, an air-blowing chamber, in which the fan is arranged, be provided on one lateral side of the casing, and a machine chamber be provided on another lateral side of the casing; and at a circumferential position at which a distance between the rotation axis of the boss portion and an inner wall surface of the air-blowing chamber is smallest on an inlet imaginary plane of the fan, the distance between the contour line of the root portion of the guide portion and the rotation axis of the boss portion be at a maximum.

Further, in this case, the center in the root shape, which is defined by the contour line of the root portion of the guide portion, may be shifted with respect to the rotation axis of the boss portion in two directions, the two directions being a first direction and a second direction, the first direction may correspond to, at the circumferential position at which the distance between the rotation axis of the boss portion and the inner wall surface of the air-blowing chamber is smallest on the inlet imaginary plane of the fan, a direction from the rotation axis of the boss portion toward a radially outer side, and the second direction may correspond to a direction orthogonal to the first direction, which is a direction corresponding, to a forward direction in a rotation direction of the fan with respect to the circumferential position at which the distance between the rotation axis of the boss portion and the inner wall surface of the air-blowing chamber is smallest.

Alternatively, it is preferred that: the casing include a bellmouth part in an upper portion of the casing, and a body part in a lower portion of the casing; the fan be arranged in the bellmouth part, and the fan guard be provided on an upper portion of the bellmouth part; in the body part, the heat exchanger be arranged on one opposing side surface, and an electrical component box be arranged on another opposing side surface; and at a circumferential position at which a horizontal distance between the rotation axis of the boss portion and the electrical component box is smallest, the distance between the contour line of the root portion of the guide portion and the rotation axis of the boss portion be at a maximum.

Further, in this case, the center in the root shape, which is defined by the contour line of the root portion of the guide portion, may be shifted with respect to the rotation axis of the boss portion in two directions, the two directions being a first direction and a second direction, the first direction may correspond to, from the rotation axis of the boss portion, at the circumferential position at which the horizontal distance between the rotation axis of the boss portion and the electrical component box is smallest, a direction from the rotation axis of the boss portion toward a radially outer side, and the second direction may correspond to a direction orthogonal to the first direction, which is a direction corresponding to a forward direction in a rotation direction of the fan with respect to the circumferential position at which the horizontal distance between the rotation axis of the boss portion and the electrical component box is smallest.

Advantageous Effect of Invention

According to the one embodiment of the present invention, the turbulence of the flow on the downstream side of the boss portion may be reduced over the entire circumferential rotation direction of the fan.

DESCRIPTION OF EMBODIMENTS

Figure 1:
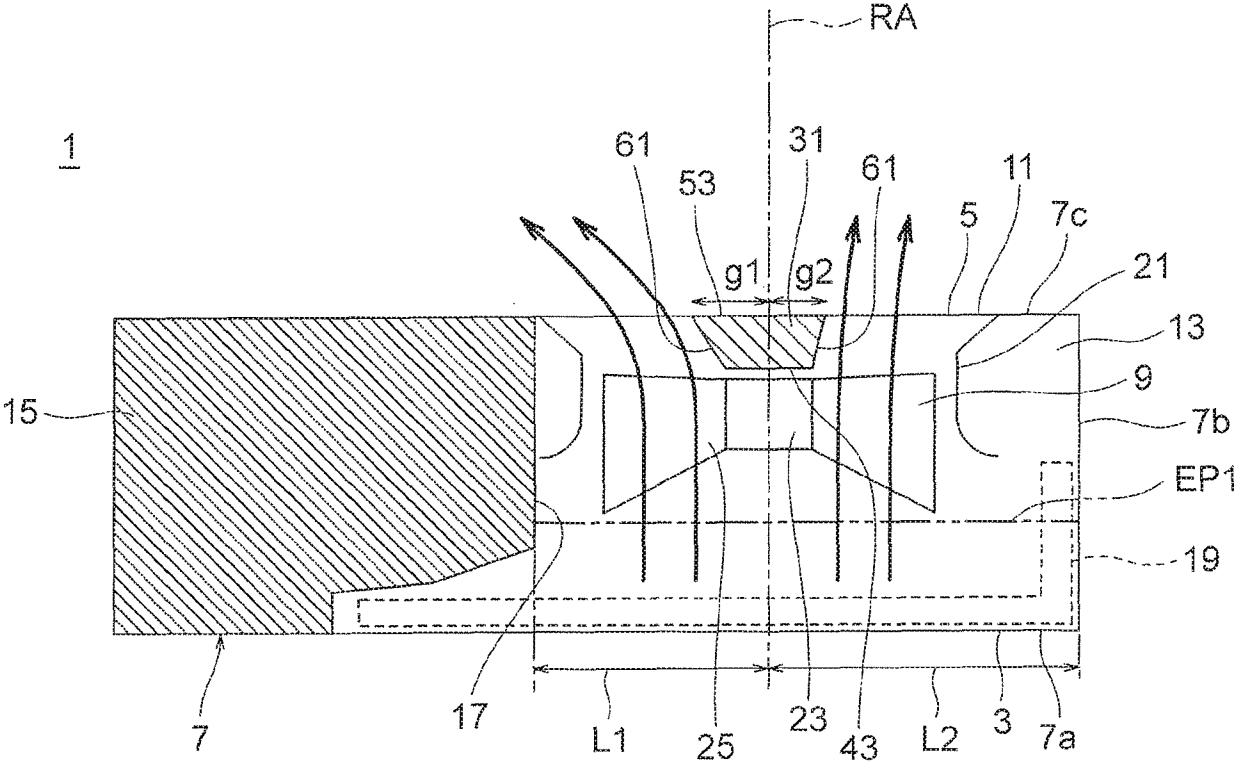
FIG. 1 is a plan view for schematically illustrating a configuration of an outdoor unit according to a first embodiment of the present invention.

Now, embodiments of the present invention are described with reference to the accompanying drawings. Note that, in the drawings, the same reference symbols represent the same or corresponding parts.

First Embodiment

FIG. 1 is a plan view for schematically illustrating a configuration of an outdoor unit according to a first embodiment of the present invention. An outdoor unit 1 is an example of a so-called package air-conditioner outdoor unit, and includes at least a casing 7 having an air inlet portion 3 and an air outlet portion 5, a fan 9, such as an axial-flow propeller fan, which is provided in the casing 7 so as to be rotatable, and a fan guard 11 provided at the air outlet portion 5 of the casing 7.

In the casing 7, an air-blowing chamber 13, in which the fan 9 is arranged, is provided on one lateral side thereof (illustrated on the right side of the drawing sheet of FIG. 1), and a machine chamber 15 is provided on another lateral side thereof (left side of the drawing sheet of FIG. 1) The air-blowing chamber 13 and the machine chamber 15 are partitioned by a partition wall 17.

The air inlet portion 3 is formed through a rear surface 7*a* and a side surface 7*b* of the casing 7 in the air-blowing chamber 13, and the air outlet portion 5 is formed through a front surface 7*c* of the casing 7 in the air-blowing chamber 13.

A heat exchanger 19, the fan. 9, and a bellmouth 21 are housed in the air-blowing chamber 13. In plan view, the heat exchanger 19 extends in an L-shaped manner along the air inlet portion 3 of the rear surface 7*a* and the side surface 7*b* of the casing 7. The fan 9 is provided on a downstream side of the heat exchanger 19 so as to be rotatable, and is rotated due to a drive force of a fan motor as is well known. Further, the bellmouth 21 is provided on a radially outer side of the fan 9 so as to surround the fan The fan 9 includes a boss portion 23 and a plurality of blades 25. The boss portion 23 corresponds to a cylindrical portion located at a rotation center portion (portion including a rotation axis PA and the vicinity thereof). The plurality of blades 25 are each formed so as to extend from an outer circumferential surface of the boss portion 23 toward the radially outer side.

With such a configuration, when the fan 9 is rotated, air sucked through the air inlet portion 3 passes through the heat exchanger 19, and is conveyed toward the air outlet portion 5 by the fan 9. Then, the air passes through the fan guard 11 at the air outlet portion 5, and is blown out of the casing 7.

Figure 2:
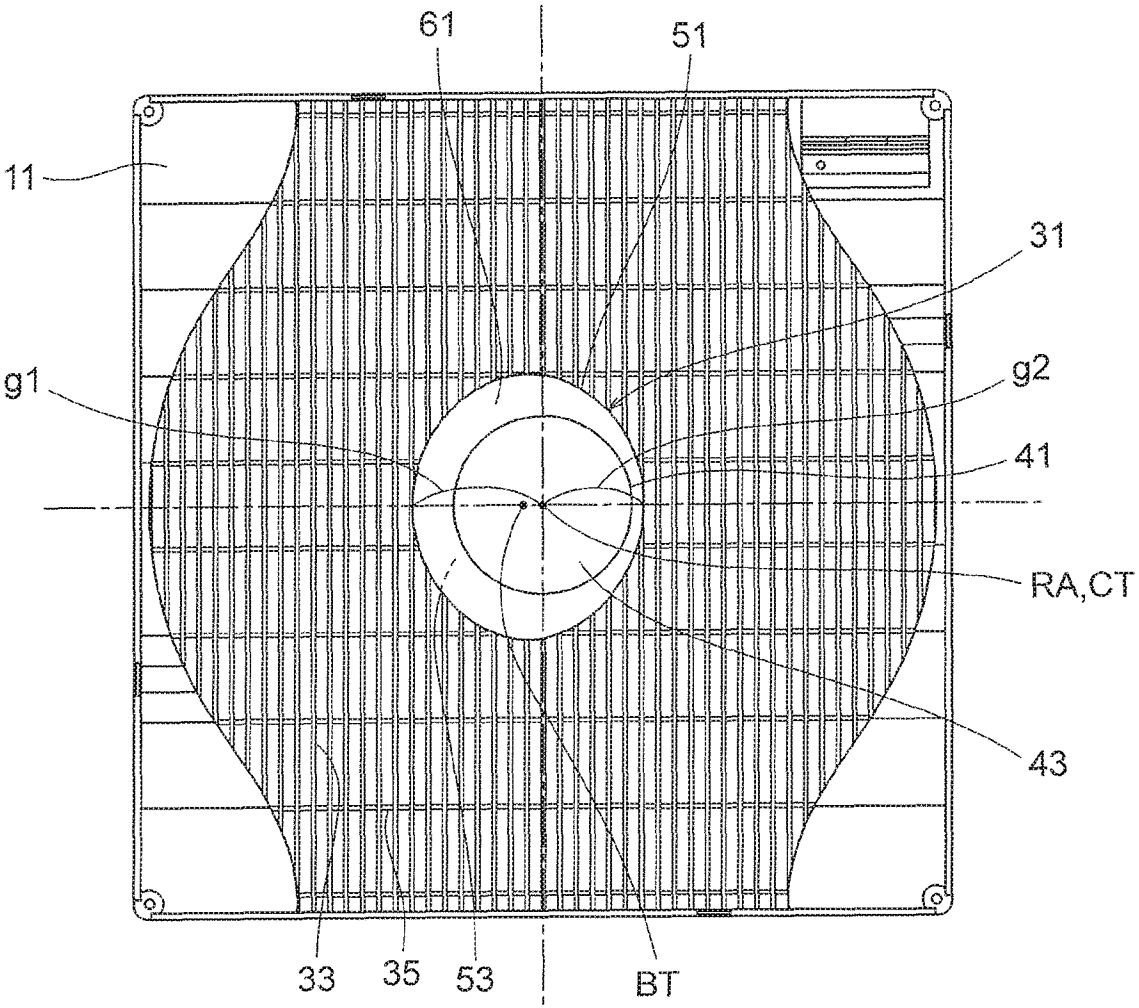
FIG. 2 is a view for illustrating the first embodiment, in which a fan guard is viewed from a fan side along a rotation axis of the fan.

Note that, the machine chamber 15 has a well-known configuration, and, for example, accommodates devices relating to control of circulation of a refrigerant in a refrigeration cycle including the heat exchanger 19 and control of drive of the fan The fan guard 11 includes a guide portion 31 having a tubular outer shape, which protrudes toward the fan 9. Referring to FIG. 1 and FIG. 2, the fan guard 11 and the guide portion 31 are described in detail. FIG. 2 is a view for illustrating the first embodiment, in which the fan guard is viewed from the fan side along the rotation axis RA of the fan (boss portion).

The fan guard 11 includes a plurality of rib portions arrayed in a lattice shape. In the first embodiment, as the plurality of rib portions, a plurality of main rib portions 33 extending in a longitudinal direction and a plurality of sub-rib portions 35 extending in a lateral direction cross each other substantially at a right angle. The plurality of main rib portions 33 are provided mainly for the purpose of prevention of contact between the fan 9 and a hand or foreign matters, whereas the plurality of sub-rib portions 35 are provided for the purpose of suppression of strain or deformation of the main rib portions 33.

The guide portion 31 extends along the rotation axis RA of the fan, and corresponds to a solid portion of a truncated conical body as an example in the first embodiment. A center (center of figure) CT in a distal end shape 43, which is defined by a contour line 41 of a distal end portion of the protrusion of the guide portion 31 (end portion closer to the boss portion 23), matches with the rotation axis RA of the boss portion 23. In particular, in the first embodiment, the distal end shape 43, which is defined by the contour line 41 of the distal end portion of the guide portion 31, is a circle. Thus, the shape, area, and center of the circle of the distal end shape 43 match with the shape, area, and center of a circle of a projected end surface shape of the boss portion 23.

On the other hand, a center (center of figure) BT in a root shape 53, which is defined by a contour line 51 of a root portion of the protrusion of the guide portion 31 (root imaginary plane of the protrusion continuous with the fan guard 11), is shifted with respect to the rotation axis RA of the boss portion 23 in a direction described later. Further, a distance between the rotation axis RA of the boss portion 23 and the contour line 51 of the root portion of the protrusion of the guide portion 31 (root imaginary plane of the protrusion continuous with the fan guard 11) is larger on the left side of the drawing sheet of FIG. 2 (one side on which airflow resistance to be described later is relatively large) than on the right side of the drawing sheet (one side on which the airflow resistance to be described later is relatively small).

Further, the root shape 53 and the distal end shape 43 have the following relationship. When viewed in a projected manner in a direction of the rotation axis RA as illustrated in FIG. 2, the entire contour line 51 of the root portion of the guide portion 31 is located on the radially outer side of the contour line 41 of the distal end portion of the guide portion 31, or a part of the contour line 51 overlaps with the contour line 91 and the remaining part of the contour line 51 is located on the radially cuter side of the contour line 41 (FIG. 2 is an illustration of the former case).

Therefore, a circumferential side surface 61 of the guide portion 31, which extends between the contour line 41 of the distal end portion of the guide portion 31 and the contour line 51 of the root portion of the protrusion of the guide portion 31, is inclined to be closer to the rotation axis RA as approaching to the distal end portion of the guide portion 31 (that is, tapered from the root shape 53 toward the distal end shape 43). The inclination of the circumferential side surface 61 is not uniform over the circumferential direction, but is different depending on circumferential positions.

Next, description is given of the configuration in which the distance between the contour line 51 of the root portion of the guide portion 31 and the rotation axis RA of the boss portion 23 is larger on the left side of the drawing sheet of FIG. 2 than on the right side of the drawing sheet as described above.

In general, in the casing of the package air-conditioner outdoor unit, the air-blowing chamber and the machine chamber are provided. Thus, in the air-blowing chamber, a space on the machine chamber side with respect to the rotation axis is smaller than a space on a side opposite to the machine chamber with respect to the rotation axis in many cases. That is, as illustrated in FIG. 1, a distance L1 between the rotation axis RA and the partition wall 17 is smaller than a distance L2 between the rotation axis RA and the side surface 7*b* on the side opposite to the machine chamber in the casing 7. Therefore, in FIG. 1, when an inlet imaginary plane EP1 orthogonal to the rotation axis RA at an upstream end of the fan 9 is considered, an air inlet flow passage on the machine chamber 15 side with respect to the rotation axis RA (left side of the drawing sheet) is smaller than an air inlet flow passage on the side opposite to the machine chamber 15 with respect to the rotation axis RA (right side of the drawing sheet) on the imaginary plane. That is, the airflow resistance is larger on one radial side (left side of the drawing sheet in the radial direction being the horizontal direction) than on another radial side (right side of the drawing sheet in the radial direction being the horizontal direction) across the rotation axis RA. Due to the above, in the first embodiment, as illustrated in FIG. 2, the distance between the contour line 51 of the root portion of the guide portion 31 and the rotation axis RA of the boss portion 23 is set to be larger on the left side of the drawing sheet of FIG. 2 than on the right side of the drawing sheet. More specifically, at a circumferential position at which the distance between the rotation axis RA of the boss portion 23 and the partition wall 17 being an inner wall surface of the air-blowing chamber 13 is smallest on the inlet imaginary plane EP1 of the fan, it is preferred that the distance between the contour line 51 of the root portion of the guide portion 31 and the rotation axis RA of the boss portion 23 have a maximum value.

Figure 3:
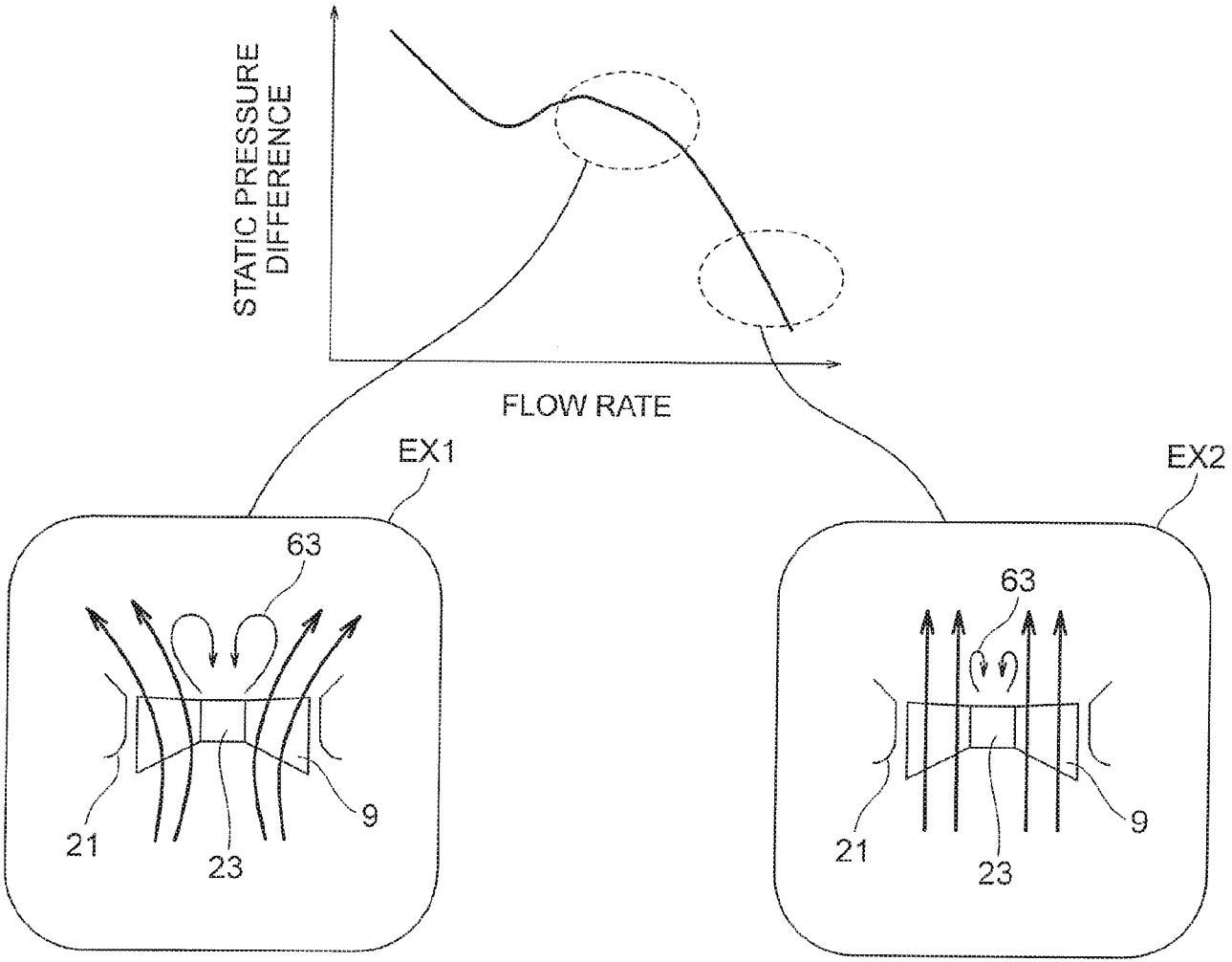
FIG. 3 is a view for illustrating difference in air flowing manner in the fan based on a relationship between static pressure difference and a flow rate.

Further, description is given of the configuration in which the distance between the contour line 51 of the root portion and the rotation axis RA is set as described above. FIG. 3 is a view for illustrating difference in air flowing manner in the fan based on a relationship between static pressure difference and a flow rate. A flow having relatively small airflow resistance is a flow having a high flow rate and small static pressure difference. Such a flow flows relatively straight as illustrated as EX2 in FIG. 3. On the other hand, a flow having relatively large airflow resistance is a flow having a low flow rate and large static pressure difference. Such a flow flows be spread out toward a relatively radially outer side at an outlet of the fan as illustrated as EX1 in FIG. 3. In each of the flow of EX1 and the flow of EX2, a turbulent flow 63 having a backflow and a vortex is generated on an immediately downstream side of the boss portion 23. Particularly in the flow of EX1 having large airflow resistance, the turbulent flow 63 is generated in a relatively wide range. When such states of the flows are applied in the above-mentioned package air-conditioner outdoor unit, the flow on the machine chamber 15 side with respect to the rotation axis RA (left side of the drawing sheet) corresponds to the flow of EX1 having the relatively large airflow resistance, that is, the flow to be spread out toward the relatively radially outer side at the outlet of the fan 9. Further, a flow on the side opposite to the machine chamber 15 with respect to the rotation axis RA (right side of the drawing sheet) corresponds to the flow of EX2 having the relatively small airflow resistance, that is, the flow to advance relatively straight at the outlet of the fan 9. In conformity with the respective flows, in the guide portion 31, a distance g1 between the rotation axis RA and the contour line 51 of the root portion on the one side on which the airflow resistance is relatively large is larger than a distance g2 between the rotation axis RA and the contour line 51 of the root portion of the guide portion on the another side on which the airflow resistance is relatively small.

With this, over an entire circumferential rotation direction of the fan, the circumferential side surface 61 of the guide portion 31 extends along a main stream that is blown out of the fan, and the guide portion 31 closes a space on the radially inner side of the main stream that is blown out. Thus, the turbulence of the flow can be reduced on the downstream side of the boss portion.

In the outdoor unit according to the first embodiment constructed as described above, the center in the root shape, which is defined by the contour line of the root portion of the guide portion, is shifted with respect to the rotation axis of the boss portion. Thus, even when the flow that is blown out of the fan is not uniform in the circumferential direction, the turbulence of the flow can be reduced on the downstream side of the boss portion over the entire circumferential rotation direction of the fan. Further, in particular, in the package air-conditioner outdoor unit, the airflow resistance is different on each of the machine chamber side and the side opposite to the machine chamber across the rotation axis of the boss portion. In the first embodiment, the distance between the rotation axis of the boss portion and the contour line of the root portion of the guide portion on the machine chamber side on which the airflow resistance is relatively large is larger than the distance between the rotation axis of the boss portion and the contour line of the root portion of the guide portion on the side opposite to the machine chamber on which the airflow resistance is relatively small. Thus, the turbulence of the flow can be reduced on the downstream side of the boss portion over the entire circumferential rotation direction of the fan. In particular, on the machine chamber side on which the airflow resistance is relatively large, owing to the guide portion, the generation of the turbulent flow can be reduced in the flow to be spread out toward the radially outer side. On the side opposite to the machine chamber on which the airflow resistance is relatively small, such a situation is avoided that the circumferential side surface of the guide portion hinders the substantially straight flow.

Second Embodiment

Figure 4:
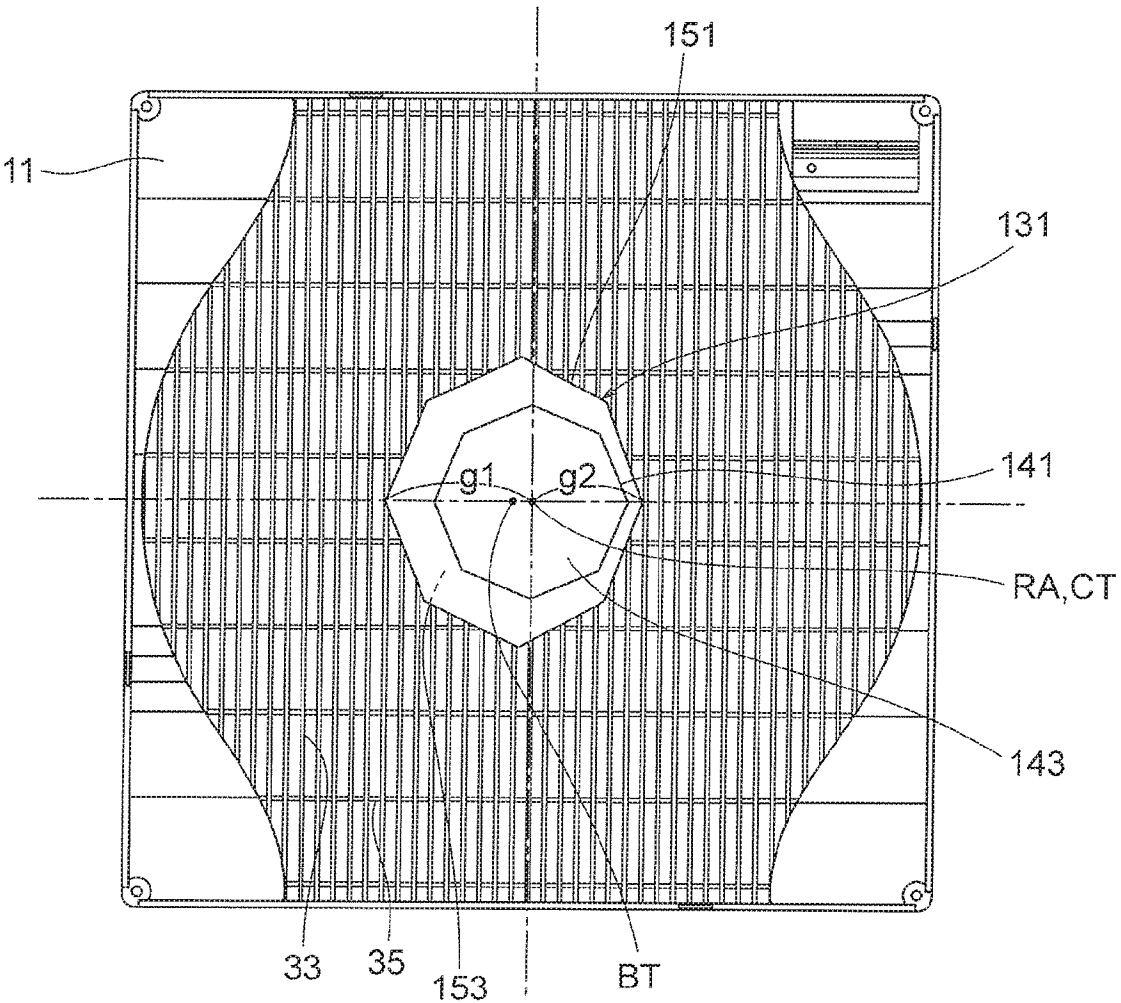
FIG. 4 is a view similar to FIG. 2, for illustrating a second embodiment of the present invention.

Next, a second embodiment of the present invention is described. FIG. 4 is a view similar to FIG. 2, for illustrating the second embodiment. Note that, except for the parts to be described below, the second embodiment is similar to the above-mentioned first embodiment.

In the present invention, the contour line of the distal end portion and the contour line of the root portion of the guide portion are not limited to have a circular shape. In the second embodiment, as another example, the contour line of the distal end portion and the contour line of the root portion have a polygonal shape. That is, a guide portion 131 of the second embodiment is a truncated pyramid body. As illustrated in FIG. 4, both of a contour line 141 of the distal end portion and a contour line 151 of the root portion have a polygonal shape (in the illustrated, example, octagonal shape).

Also in the second embodiment, similarly to the first embodiment, the center (center of figure) CT in a distal end shape 143, which is defined by the contour line 141 of the guide portion 131, matches with the rotation axis RA of the boss portion 23. Further, the center (center of FIG. 31 in a root shape 153, which is defined by the contour line 151 of the guide portion 131, is shifted with respect to the rotation axis RA of the boss portion 23. With this configuration, the distance between the rotation axis RA of the boss portion 23 and the contour line 151 of the root portion of the protrusion of the guide portion 131 is larger on the left side of the drawing sheet of FIG. 4 (machine chamber side, that is, the one side on which the airflow resistance is relatively large) than on the right side of the drawing sheet (side opposite to the machine chamber, that is, the one side on which the airflow resistance is relatively small).

Also in the second embodiment, similarly to the first embodiment, the turbulence of the flow can be reduced on the downstream side of the boss portion over the entire circumferential rotation direction of the fan.

Third Embodiment

Next, a third embodiment of the present invention is described.

Figure 5:
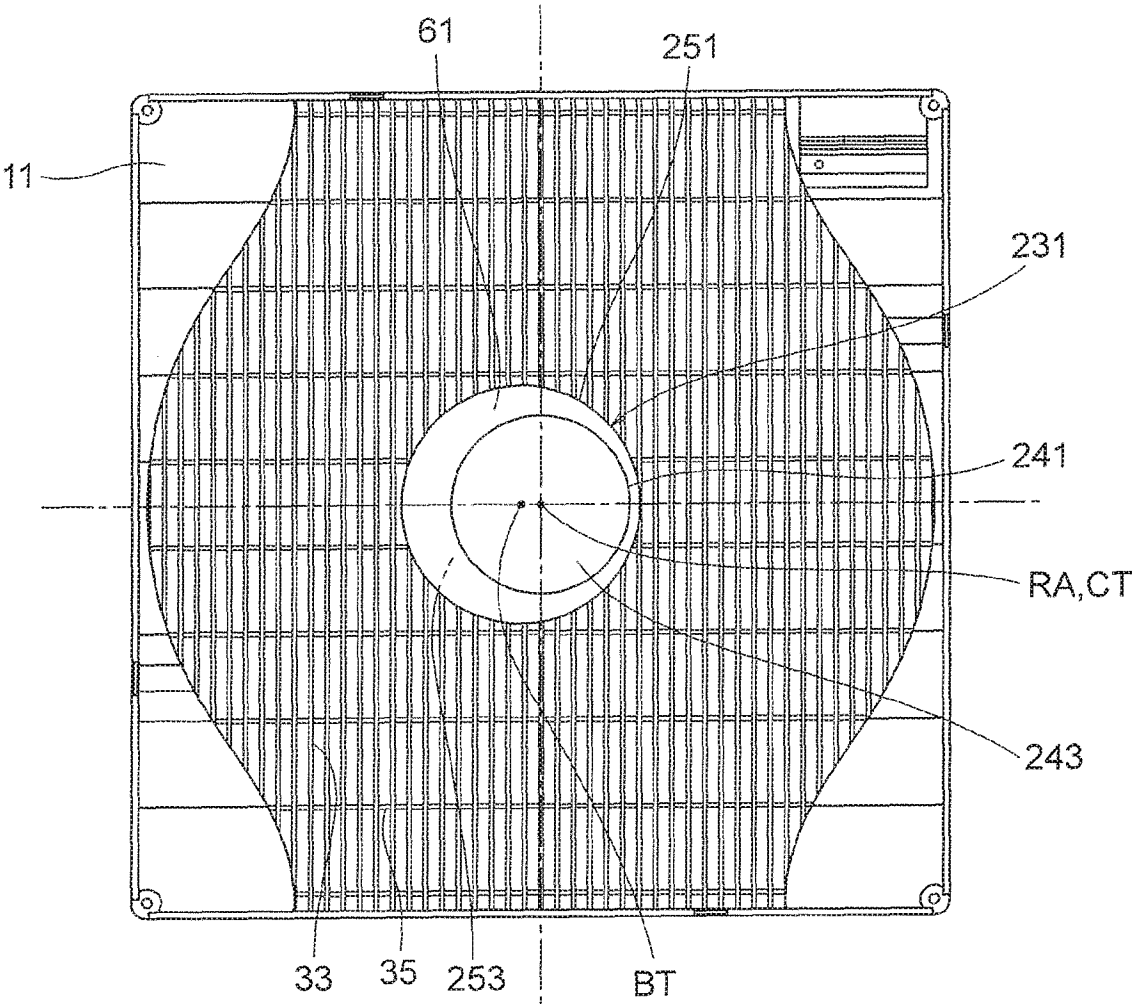
FIG. 5 is a view similar to FIG. 2, for illustrating a third embodiment of the present invention.

FIG. 5 is a view similar to FIG. 2, for illustrating the third embodiment. Note that, except for the parts to be described below, the third embodiment is similar to the above-mentioned first and second embodiments.

In the present invention, both of the contour line of the distal end portion and the contour line of the root portion of the guide portion may have a perfect circular shape or a regular polygonal shape. Note that, FIG. 5 is an illustration of an example of a case where both of the contour lines have a perfect circular shape. A guide portion 231 of the third embodiment is a truncated conical body. As illustrated in FIG. 5, a contour line 241 of the distal end portion has a perfect circular shape with the center (center of figure) CT, and a contour line 251 of the root portion has a perfect circular shape with the center (center of figure) BT.

Also in the third embodiment, similarly to the first embodiment, the center (center of figure) CT in a distal end shape 243, which is defined by the contour line 241 of the guide portion 231, matches with the rotation axis RA of the boss portion 23. Further, the center (center of figure) BT in a root shape 253, which is defined by the contour line 251 of the guide portion 231, is shifted with respect to the rotation axis RA of the boss portion 23. With this configuration, the distance between the rotation axis RA of the boss portion 23 and the contour line 251 of the root portion of the protrusion of the guide portion 231 is larger on the left side of the drawing sheet of FIG. 5 (machine chamber side, that is, the one side on which the airflow resistance is relatively large) than on the right, side of the drawing sheet (side opposite to the machine chamber, that is, the one side on which the airflow resistance is relatively small).

Also in the third embodiment, similarly to the first embodiment, the turbulence of the flow can be reduced on the downstream side of the boss portion over the entire circumferential rotation direction of the fan.

Fourth Embodiment

Figure 6:
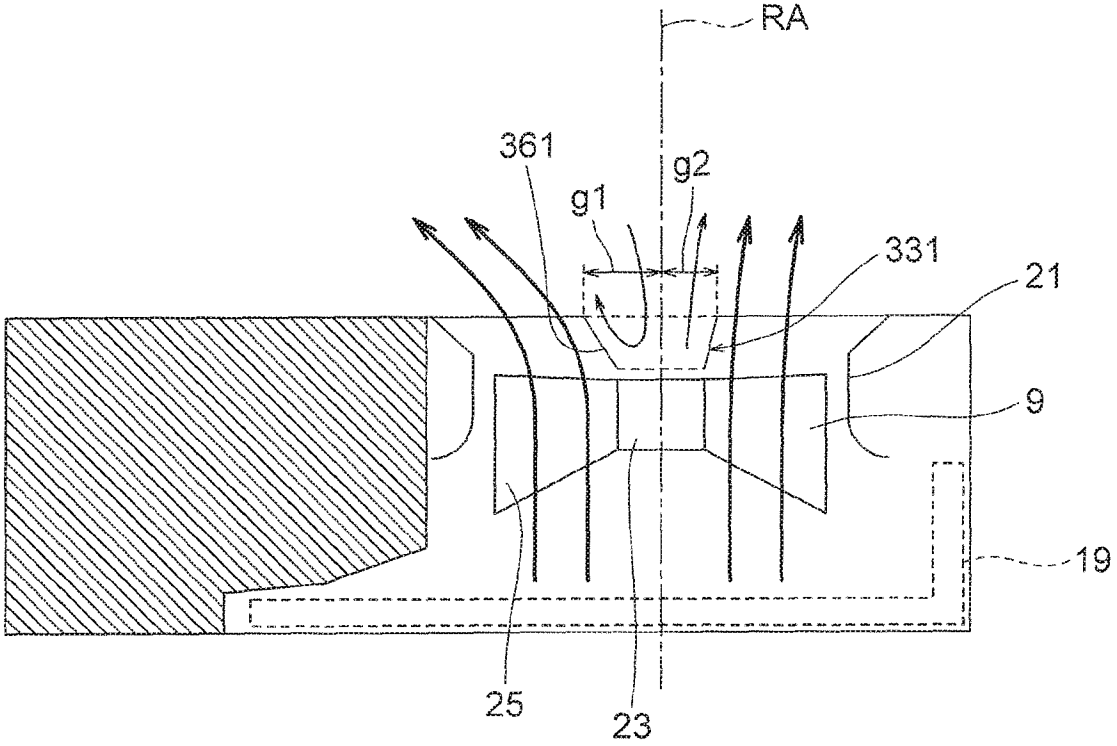
FIG. 6 is a view similar to FIG. 1, for illustrating a fourth embodiment of the present invention.

Next, a fourth embodiment of the present invention is described. FIG. 6 is a view similar to FIG. 1, for illustrating the fourth embodiment. Note that, except for the parts to be described below, the fourth embodiment is similar to any one of the above-mentioned first to third embodiments or a combination thereof.

In the present invention, the surface of the distal end portion and the surface of the root portion of the guide portion are not limited to be the closed surfaces. That is, in the fourth embodiment of the present invention, there is given an example of a case where the distal end portion and the root portion of the guide portion are opened. Note that, the contour line of the distal end portion and the contour line of the root portion of the guide portion may have a circular shape or a polygonal shape.

A guide portion 331 is a tubular body extending along the rotation axis RA of the boss portion 23 from the root portion to the distal end portion and allowing an air stream to pass therethrough. An upstream, edge portion of a circumferential side surface 361 of the guide portion 331 defines the contour line of the distal end portion, whereas a downstream edge portion of the circumferential side surface 361 defines the contour line of the root portion. Further, the contour line itself of the distal end portion and the contour line itself of the root portion have a circular shape or a polygonal shape, and each of the contour line of the distal end portion and the contour line of the root portion has an opening on an inner side.

Also in the fourth embodiment, each of the contour line itself of the distal end portion and the contour line itself of the root portion is similar to that of any one of the above-mentioned first to third embodiments. The center (center of figure) CT in the distal end shape, which is defined by the contour line of the distal end portion, matches with the rotation axis RA of the boss portion 23. The center (center of figure) BT in the root shape, which is defined by the contour line of the root portion, is shifted with respect to the rotation axis idiot the boss portion 23. Further, with this configuration, the distance between the contour line of the root portion and the rotation axis RA of the boss portion is larger on the left side of the drawing sheet of FIG. 6 (machine chamber side, that is, the one side on which the airflow resistance is relatively large) than on the right side of the drawing sheet (side opposite to the machine chamber, that is, the one side on which the airflow resistance is relatively small).

Also in the fourth embodiment, similarly to the first embodiment, the turbulence of the flow can be reduced on the downstream side of the boss portion over the entire circumferential rotation direction of the fan. Further, in the fourth embodiment, the guide portion is a hollow tubular body having an opening in each of the root portion and the distal end portion. Thus, for the flow having the relatively large airflow resistance to be spread out toward the radially outer side, instead of suppressing generation of a backflow itself, a backflow on the inner side of the guide portion can be prevented from interfering with the main stream on the outer side of the guide portion. For the flow having the relatively small airflow resistance to flow substantially straight, the flow into the inner side of the guide portion is also allowed, and hence the circumferential side surface of the guide portion can be further prevented from hindering the flow.

Fifth Embodiment

Figure 7:
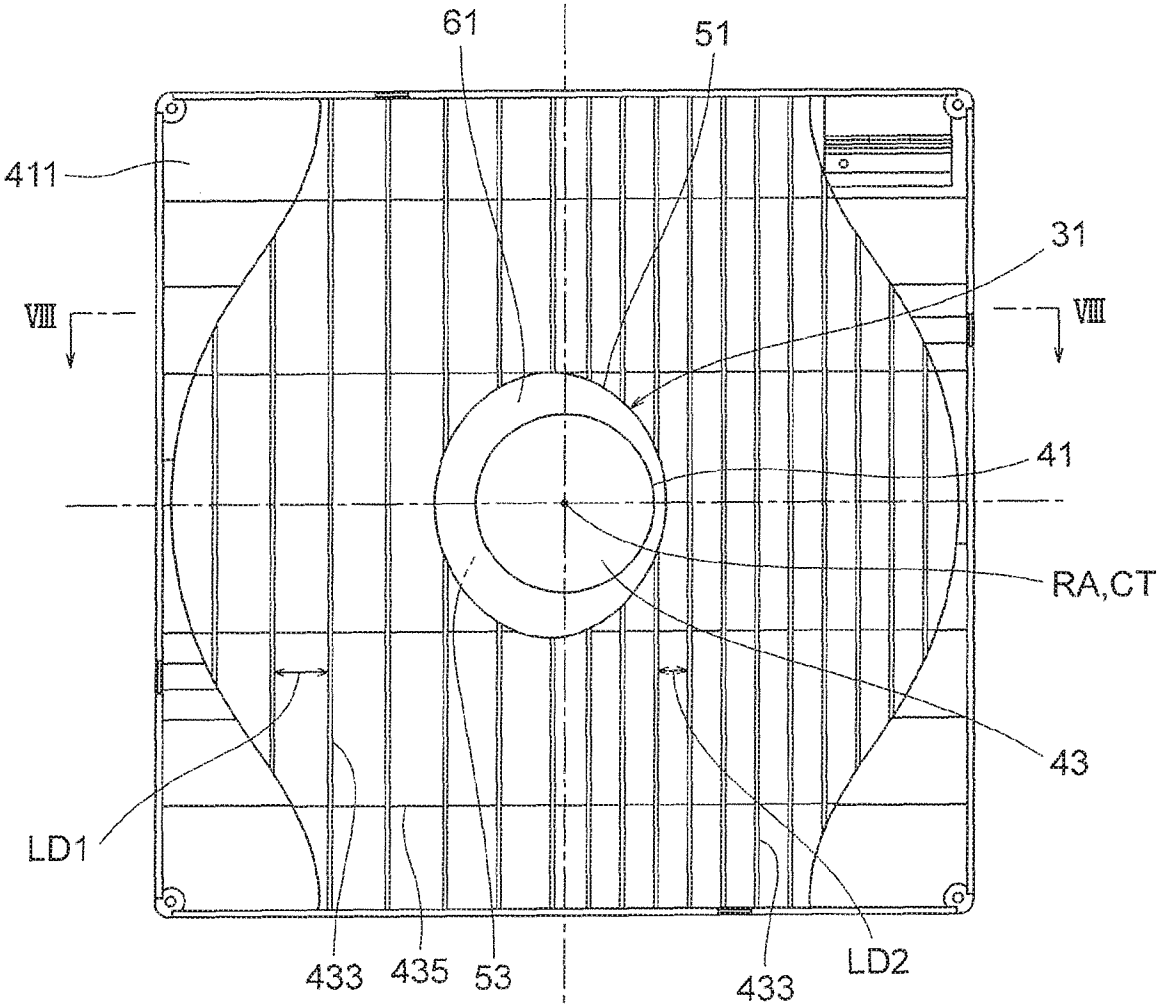
FIG. 7 is a view similar to FIG. 2, for illustrating a fifth embodiment of the present invention.
Figure 8:
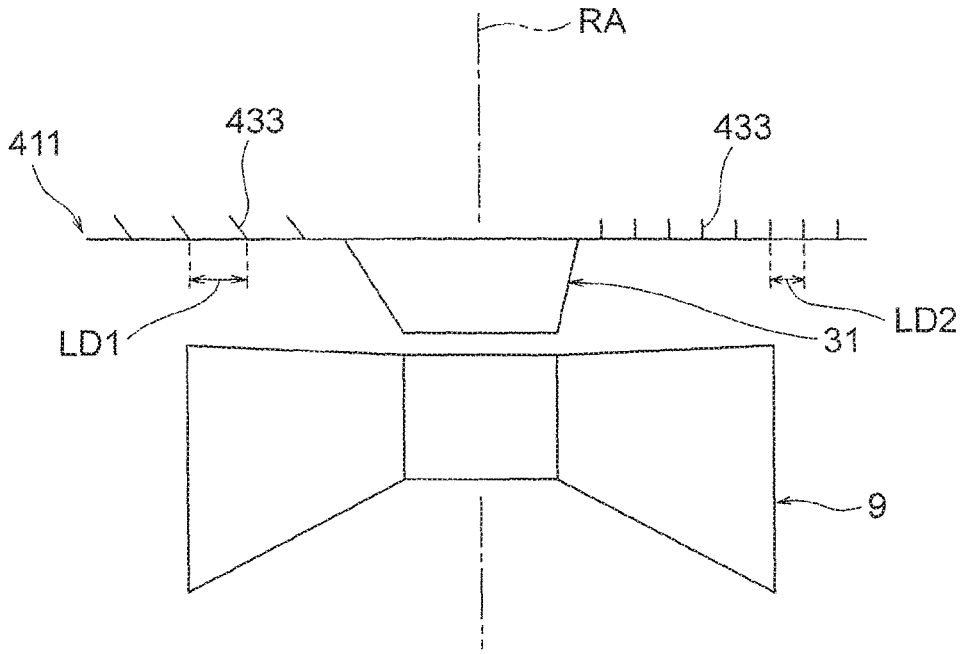
FIG. 8 is a plan view taken along the line VIII-VIII of FIG. 7, for illustrating a plurality of rib portions of the fan guard.

Next, a fifth embodiment of the present invention is described. FIG. 7 is a view similar to FIG. 2, for illustrating the fifth embodiment. FIG. 8 is a plan view taken along the line VIII-VIII of FIG. 7, for illustrating a plurality of rib portions of the fan guard. Note that, except for the parts to be described below, the fifth embodiment is similar to any one of the above-mentioned first to fourth embodiments or a combination thereof, and as an example thereof, FIG. 7 is an illustration of a case where the fifth embodiment is applied to the fan guard of the first embodiment.

A fan guard 411 includes a plurality of main rib portions 433 and a plurality of sub-rib portions 435 that are arrayed in a lattice shape. The plurality of main rib portions 433 extending in the longitudinal direction and the plurality of sub-rib portions 435 extending in the lateral direction cross each other substantially at a right angle. The plurality of main rib portions 433 are provided mainly for the purpose of prevention of contact between the fan 9 and a hand or foreign matters, whereas the plurality of sub-rib portions 435 are provided for the purpose of suppression of strain or deformation of the main rib portions 433.

In the fifth embodiment, lateral intervals LD1 between the main rib portions 433 on one lateral side on which the airflow resistance is relatively large, that is, the machine chamber side, are larger than lateral intervals LD2 between the main rib portions 433 on another lateral side on which the airflow resistance is relatively small, that is, the side opposite to the machine chamber. In addition, the main rib portions 433 on the one lateral side on which the airflow resistance is relatively large, that is, the machine chamber side, are significantly inclined with respect to the rotation axis PA of the fan more than the main rib portions 433 on the another lateral side on which the air resistance is relatively small, that is, the side opposite to the machine chamber (inclined in such a direction the on a downstream side separates away from the rotation axis PA of the fan).

Also in the fourth embodiment, similarly to the first embodiment, the turbulence of the flow can be reduced on the downstream side of the boss portion over the entire circumferential rotation direction of the fan. Further, in the fifth embodiment, the intervals between the main rib portions and the orientation thereof are set as described above. Thus, for the flow having the relatively large airflow resistance to be spread out toward the radially outer side, the airflow resistance generated when passing through the fan guard can be relatively reduced. Thus, the turbulence of the flow can be reduced on both the lateral sides across the guide portion in a well-balanced manner.

Note that, both of the above-mentioned relationship of the lateral intervals between the main rib portions and relationship of the lateral orientation (inclination) thereof are not limited to be necessarily carried out. Only the relationship of the lateral intervals between the main rib portions may be carried out as illustrated in FIG. 8, and only the relationship of the lateral orientation (inclination) of the main rib portions may be carried out as illustrated in FIG. 8.

Sixth Embodiment

Figure 9:
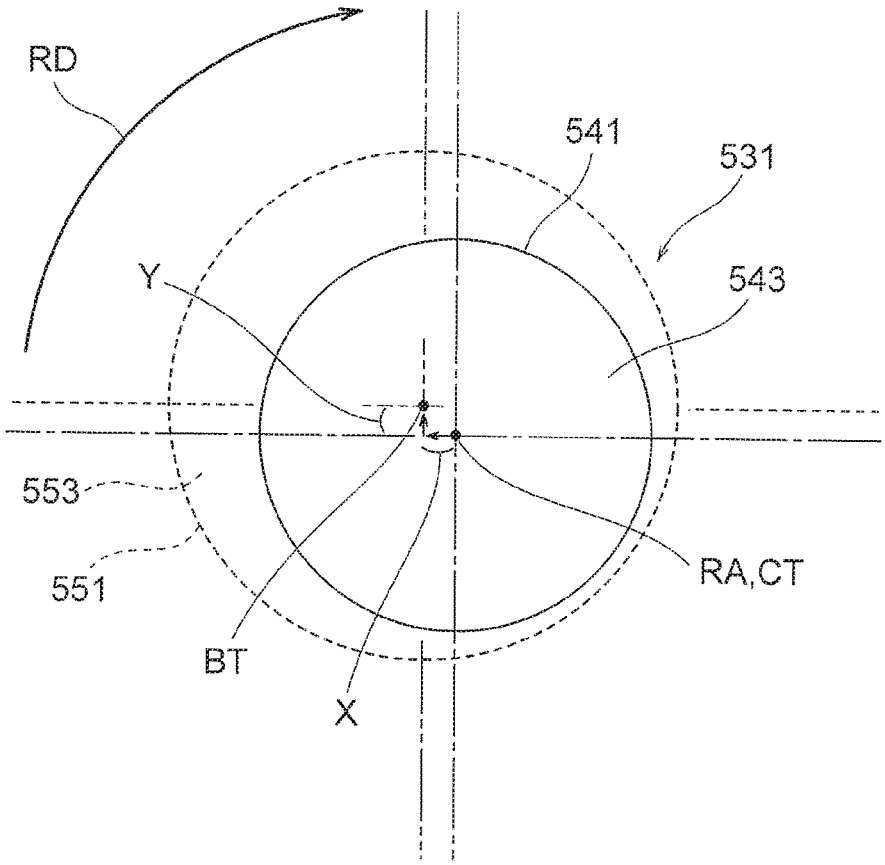
FIG. 9 is a view for illustrating a sixth embodiment of the present invention, in which a root shape of a guide portion is shifted with respect to a rotation axis of a fan.

Next, a sixth embodiment of the present invention is described. FIG. 9 is a view for illustrating sixth embodiment, in which the root shape of the guide portion is shifted with respect to the rotation axis of the fan. Note that, except for the parts to be described below, the sixth embodiment is similar to any one of the above-mentioned first to fifth embodiments or a combination thereof.

In the sixth embodiment, the center BT in a root shape 553 of a guide portion 531 is shifted in two directions in consideration of not only the imbalance of the airflow resistance but also a rotation direction of the fan. First, as a premise, the center CT in a distal end shape 543, which is defined by a contour line 541 of the guide portion 531, matches with the rotation axis RA of the boss portion 23. On the other hand, the center BT in the root shape 553, which is defined by a contour line 551 of the guide portion 531, is shifted with respect to the rotation axis RA of the boss portion 23 in the two directions, that is, a first direction and a second direction. The first direction corresponds to, at the circumferential position at which the distance between the rotation axis RA of the boss portion 23 and the inner wall surface of the air-blowing chamber 13 is smallest on the inlet imaginary plane EP1 of the fan, a direction X from the rotation axis RA of the boss portion 23 toward the radially outer side. The second direction corresponds to a direction orthogonal to the first direction X, which is a direction Y corresponding to a forward direction in the rotation direction RD of the fan 9 with respect to the circumferential position at which the distance between the rotation axis RA of the boss portion 23 and the inner wall surface of the air-blowing chamber 13 is smallest. Further, the contour line 551 of the root portion of the guide portion 531 has a perfect circular shape about the center BT shifted in the two directions as described above. The contour line, 541 of the distal end portion has a perfect circular shape about the center CT that matches with the rotation axis RA of the fan.

Also in the sixth embodiment, similarly to the first embodiment, the turbulence of the flow can be reduced on the downstream side of the boss portion over the entire circumferential rotation direction of the fan. Further, in the sixth embodiment, there is an advantage in that the guide portion can exhibit its action in consideration of the influence of the rotation of the fan affecting the flow to be spread out toward the radially outer side.

Seventh Embodiment

Figure 10:
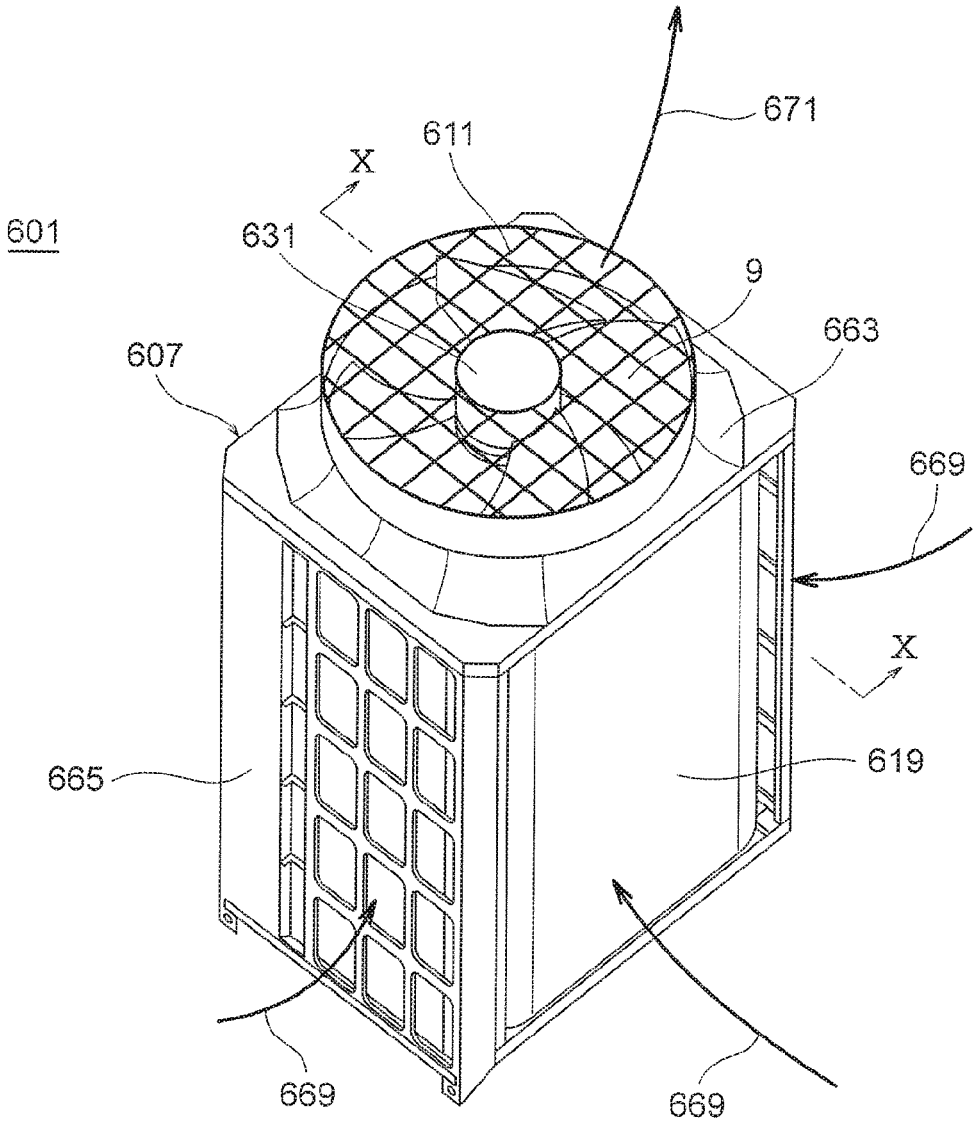
FIG. 10 is a perspective view for illustrating an external appearance of an outdoor unit of an air-conditioning apparatus according to a seventh embodiment of the present invention.
Figure 11:
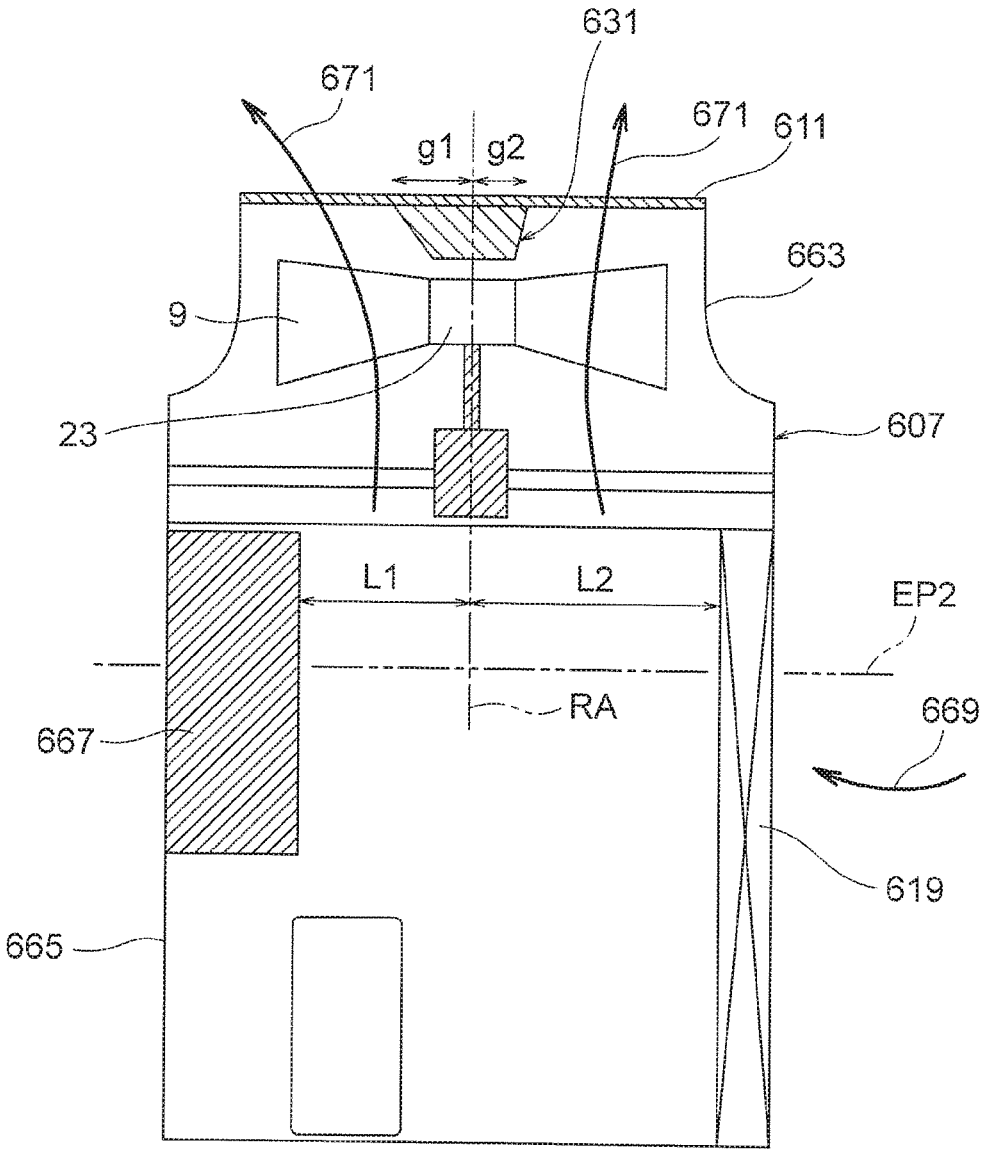
FIG. 11 is a view for illustrating an internal configuration of the outdoor unit of the air-conditioning apparatus when viewed along the line X-X of FIG. 10.

Next, a seventh embodiment of the present invention is described. FIG. 10 is a perspective view for illustrating an external appearance of an outdoor unit of an air-conditioning apparatus according to the seventh embodiment of the present invention. FIG. 11 is a view for illustrating an internal configuration of the outdoor unit of the air-conditioning apparatus when viewed along the line X-X of FIG. 10. An outdoor unit 601 is an example of a so-called multi-air-conditioner outdoor unit for a building. Note that, except for the parts to be described below, the seventh embodiment is similar to any one of the above-mentioned first to sixth embodiments or a combination thereof.

As illustrated in FIG. 10, a casing 607 of the outdoor unit 601 includes a bellmouth part 663 in an upper portion thereof, and a body part 665 in a lower portion thereof. The fan 9 is arranged in the bellmouth part 663, and a fan guard 611 is provided on an upper portion of the bellmouth part 663. Note that, a configuration of the ribs of the fan guard 611 is similar to that of any one of the above-mentioned embodiments.

The body part 665 is formed into a rectangular shape in plan view, and has four side surfaces made up of one panel and three mesh plates. In the body part 665, a heat exchanger 619 constructed in a substantially U-shaped manner in plan view is arranged along the side surfaces of the three mesh plates. Further, in the body part 665, an electrical component box 667 is provided so as to be opposed to the heat exchanger 619. The electrical component box 667 is arranged along the panel being the side surface other than the side, surfaces along which the heat exchanger 619 is arranged. Note that, the electrical component box 667 incorporates a circuit board for driving a compressor and a fan motor.

With this, in the outdoor unit 601, air is sucked into the body part 665 through each of the three side surfaces (air inlet portions) of the body part 665 as indicated by the arrows 669. The air then exchanges heat at each of three heat exchanging function surfaces to be discharged through the fan guard 611 (air outlet portion) provided on the upper surface of the bellmouth part 663 as indicated by the arrow 671 (top flow type).

The fan guard 611 includes a guide portion 631 having a tubular outer shape, which protrudes toward the fan 9. The guide portion 631 is formed similarly to the guide portion of any one of the above-mentioned embodiments. Also in the guide portion 631, the center (center of figure) in the distal end shape, which is defined by the contour line of the distal end portion, matches with the rotation axis RA of the boss portion 23.

On the other hand, the center (center of figure) in the root shape, which is defined by the contour line of the root portion of the guide portion 631, is shifted with respect to the rotation axis RA of the boss portion 23. Further, in the distance between the contour line of the root portion of the guide portion 631 and the rotation axis RA of the boss portion 23, the distance g1 on the left side of the drawing sheet of FIG. 2 is larger than the distance g2 on the right side of the drawing sheet.

In general, in the multi-air-conditioner outdoor unit for a building, in the body part 665, a space on the electrical component box 667 side with respect to the rotation axis is smaller than a space on the heat exchanger 619 side with respect to the rotation axis (space on a side opposite to the electrical component box side) in many cases. That is, as illustrated in FIG. 11, a horizontal distance L1 between the rotation axis R2 and the electrical component box 667 is smaller than a horizontal distance L2 between the rotation axis RA and the heat exchanger 619. Therefore, in FIG. 11, when an inlet imaginary plane EP2 that is orthogonal to the rotation axis RA at the upstream end of the fan 9 and has a height crossing the electrical component box 667 and the heat exchanger 619 is considered, an air inlet flow passage on the electrical component box 667 side with respect to the rotation axis RA (left side of the drawing sheet) is smaller than an air inlet flow passage on the heat exchanger 619 side with respect to the rotation axis RA on the imaginary plane. That is, the airflow resistance is larger on one radial site (left side of the drawing sheet in plan view) than on another radial side (right side of the drawing sheet in plan view) across the rotation axis PA. Due to the above, in the seventh embodiment, the distance between the contour line of the root portion of the guide portion 631 and the rotation axis RA of the boss portion 23 is set larger on the left side of the drawing sheet of FIG. 11 than on the right side of the drawing sheet. More specifically, at a circumferential position at which the horizontal distance L1 between the rotation axis RA of the boss portion 23 and the electrical component box 667 is smallest, it is preferred that the distance between the contour line of the root portion of the guide portion 631 and the rotation axis RA of the boss portion 23 have a maximum value.

According to the seventh embodiment, also in the multi-air-conditioner outdoor unit for a building, similarly to the first embodiment, the turbulence of the flow can be reduced on the downstream side of the boss portion over the entire circumferential rotation direction of the fan.

Eighth Embodiment

Next, an eighth embodiment of the present invention is described in the above-mentioned sixth embodiment, in the package air-conditioner outdoor unit, the center in the root shape of the guide portion is shifted in the two directions. In the eighth embodiment, in the multi-air-conditioner outdoor unit for a building, similarly to the above-mentioned sixth embodiment, the center in the root shape of the guide portion is shifted in two directions in consideration of not only the imbalance of the airflow resistance but also the rotation direction of the fan.

That is, the details are similar to those given in the description of the sixth embodiment and FIG. 9 (embodiment understood considering FIG. 9 as a plan view). Also in the eighth embodiment, the center in the root shape, which is defined by the contour line of the root portion of the guide portion, is shifted with respect to the rotation axis of the boss portion in the two directions, that is, the first direction and the second direction. The first direction corresponds to, from the rotation axis of the boss portion, at the circumferential position at which the horizontal distance between the rotation axis of the boss portion and the electrical component box is smallest, the direction from the rotation axis of the boss portion toward the radially outer side. The second direction corresponds to the direction orthogonal to the first direction, which is the direction corresponding to the forward direction in the rotation direction of the fan with respect to the circumferential position at which the horizontal distance between the rotation axis of the boss portion and the electrical component box is smallest.

According to the eighth embodiment, also in the multi-air-conditioner outdoor unit for a building, similarly to the sixth embodiment, there is an advantage in that the turbulence of the flow can be reduced on the downstream side of the boss portion over the entire circumferential rotation direction of the fan, and in that the guide portion can exhibit its action in consideration of the influence of the rotation of the fan affecting the flow to be spread out toward the radially outer side.

Although the details of the present invention are specifically described above with reference to the preferred embodiments, it is apparent that persons skilled in the art may adopt various modifications based on the basic technical concepts and teachings of the present invention.

Further, each of the plurality of embodiments described above is an example of a case where the air blower of the present invention is carried out as an outdoor unit of an air-conditioning apparatus, but the present invention is not limited only to the outdoor unit. Thus, the embodiment as illustrated in FIG. 1 is widely applicable to a configuration in which the airflow resistance is larger on one side with respect to the rotation axis RA of the fan than on another side due to the conditions on the layout other than the machine chamber. The embodiment as illustrated in FIG. 11 is widely applicable to a configuration in which the airflow resistance is larger on one side with respect to the rotation axis RA of the fan than on another side due to the conditions on the layout other than the electrical component box and the heat exchanger.

REFERENCE SIGNS LIST

1, 601 outdoor unit, 3 air inlet portion, 5 air outlet portion, 7, 607 casing, 9 fan, 11, 411, 611 fan guard, 13 air-blowing chamber, 19, 619 heat exchanger, 21 bellmouth, 23 boss portion, 25 blade, 31, 131, 231, 331, 531 guide portion, 33, 433 main rib portion, 35, 435 sub-rib portion, 41, 141, 241 contour line of distal end portion, 43, 143, 243 distal end shape, 51, 151, 251 contour line of root portion, 53, 153, 253 root shape, 61, 361 circumferential side surface, 663 bellmouth part, 665 body part, 667 electrical component box.

The invention claimed is:

1. An air blower, comprising:

a casing having an air inlet portion and an air outlet portion;

a fan provided in the casing so as to be rotatable; and a fan guard provided at the air outlet portion of the casing, wherein:

the fan comprises a boss portion, and a plurality of blades provided on an outer circumferential surface of the boss portion;

the fan guard comprises a guide portion having a tubular outer shape, which protrudes toward the fan;

a center in a distal end shape, which is defined by a contour line of a distal end portion of the guide portion, matches with a rotation axis of the boss portion; and a center in a root shape, which is defined by a contour line of a root portion of the guide portion, is shifted with respect to the rotation axis of the boss portion.

2. An air blower according to claim 1, wherein:

on an inlet side of the fan, airflow resistance is larger on one radial side than on another radial side across the rotation axis of the boss portion; and a distance between the contour line of the root portion of the guide portion and the rotation axis of the boss portion on the one side on which the airflow resistance is relatively large is larger than a distance between the contour line of the root portion of the guide portion and the rotation axis of the boss portion on the another side on which the airflow resistance is relatively small.

3. An air blower according to claim 2, wherein:

the fan guard comprises a plurality of rib portions arrayed in a lattice shape; and intervals between the plurality of rib portions on the one side on which the airflow resistance is relatively large are set to be larger than intervals between the plurality of rib portions on the another side on which the airflow resistance is relatively small, or the plurality of rib portions on the one side on which the airflow resistance is relatively large are configured to be significantly inclined with respect to the rotation axis of the boss portion more than the plurality of rib portions on the another side on which the airflow resistance is relatively small.

4. An air blower according to claim 1, wherein the guide portion comprises a tubular body extending along the rotation axis of the boss portion from the root portion to the distal end portion and allowing an air stream to pass through the tubular body.

5. An outdoor unit, comprising the air blower of claim 1, in which a heat exchanger is further arranged in the casing.

6. An outdoor unit according to claim 5, wherein:

in the casing, an air-blowing chamber, in which the fan is arranged, is provided on one lateral side of the casing, and a machine chamber is provided on another lateral side of the casing; and at a circumferential position at which a distance between the rotation axis of the boss portion and an inner wall surface of the air-blowing chamber is smallest on an inlet imaginary plane of the fan, the distance between the contour line of the root portion of the guide portion and the rotation axis of the boss portion is at a maximum.

7. An outdoor unit according to claim 6, wherein:

the center in the root shape, which is defined by the contour line of the root portion of the guide portion, is shifted with respect to the rotation axis of the boss portion in two directions, the two directions being a first direction and a second direction;

the first direction corresponds to, at the circumferential position at which the distance between the rotation axis of the boss portion and the inner wall surface of the air-blowing chamber is smallest on the inlet imaginary plane of the fan, a direction from the rotation axis of the boss portion toward a radially outer side; and the second direction corresponds to a direction orthogonal to the first direction, which is a direction corresponding to a forward direction in a rotation direction of the fan with respect to the circumferential position at which the distance between the rotation axis of the boss portion and the inner wall surface of the air-blowing chamber is smallest.

8. An outdoor unit according to claim 5, wherein:

the casing comprises a bellmouth part in an upper portion of the casing, and a body part in a lower portion of the casing;

the fan is arranged in the bellmouth part, and the fan guard is provided on an upper portion of the bellmouth part;

in the body part, the heat exchanger is arranged on one opposing side surface, and an electrical component box is arranged on another opposing side surface; and at a circumferential position at which a horizontal distance between the rotation axis of the boss portion and the electrical component box is smallest, the distance between the contour line of the root portion of the guide portion and the rotation axis of the boss portion is at a maximum.

9. An outdoor unit according to claim 8, wherein:

the center in the root shape, which is defined by the contour line of the root portion of the guide portion, is shifted with respect to the rotation axis of the boss portion in two directions, the two directions being a first direction and a second direction;

the first direction corresponds to, at the circumferential position at which the horizontal distance between the rotation axis of the boss portion and the electrical component box is smallest, a direction from the rotation axis of the boss portion toward a radially outer side; and the second direction corresponds to a direction orthogonal to the first direction, which is a direction corresponding to a forward direction in a rotation direction of the fan with respect to the circumferential position at which the horizontal distance between the rotation axis of the boss portion and the electrical component box is smallest.

10. An air blower according to claim 1, wherein the center in the root shape, which is defined by the contour line of the root portion of the guide portion, is shifted with respect to the rotation axis of the boss portion depending on an airflow hindrance factor around the fan.

* * * * *